US005651607A

United States Patent [19]

Hou

[11] Patent Number: 5,651,607

[45] Date of Patent: Jul. 29, 1997

[54] FOCUSING FLASHLIGHT

[76] Inventor: Hsien-Te Hou, No. 5, Lane 279, Chung Cheng Rd., Yung-Kang City, Tainan Hsien, Taiwan

[21] Appl. No.: 597,511

[22] Filed: Feb. 2, 1996

[51] Int. Cl.[6] ..... F21L 7/00

[52] U.S. Cl. ..... 362/188; 362/187; 362/203

[58] Field of Search ..... 362/287, 288, 362/202, 203, 205

[56] References Cited

U.S. PATENT DOCUMENTS

| | | | |
|---|---|---|---|
| 4,658,336 | 4/1987 | Maglica | 362/187 |
| 5,124,894 | 6/1992 | Shiau | 362/187 |
| 5,138,537 | 8/1992 | Wang | 362/187 |

*Primary Examiner*—Ira S. Lazarus
*Assistant Examiner*—Thomas M. Sember
*Attorney, Agent, or Firm*—Morton J. Rosenberg; David I. Klein

[57] ABSTRACT

An improved focusing flashlight is provided which includes a metallic cylinder having a collar at the front and adapted to receive a conducting cartridge and a seat insulator therein. The conducting cartridge has an internal thread formed in a centrally disposed hole and a flange extending around the perimeter of the hole, adapted to be received within a corresponding sleeve barrel extending from the seat insulator, around the perimeter of a centrally disposed hole. The internal threads of the conducting cartridge are adapted to threadedly engage a bulb.

3 Claims, 6 Drawing Sheets

FOCUSING FLASHLIGHT

BACKGROUND OF THE INVENTION

1. Field of the Invention

This invention relates to a focusing flashlight, and more particularly to an improved bulb holder having simplified structure and assembly characteristics.

2. Prior Art

The conventional focusing flashlight, as shown in FIGS. 5, 6A and 6B, comprises a metal cylinder A, a head thimble B, a lamp socket C, an insulator D, a peanut bulb E and a cylinder cap F. The metal cylinder A has a hollow battery compartment and a collar A1 at the front end thereof having threads A2 formed on the outer surface for threaded connection with the head thimble B thereon. The head thimble B receives a curved female cone reflector B1 therein. The lamp socket C is an insulating flange, having a pair of curved grooves, positioned into the collar A1 of the cylinder A. A pair of apertures C1 are formed in the center portion of the lamp socket C for receiving a pair of corresponding conducting jack strips C2, C3. The strip C2 is bent outwardly to extend along the collar A1 while the strip C3 extends through the plug aperture C1 from the other end of the lamp socket C and is bent inwardly toward the center portion in order to make contact with the center pole of the battery. The insulator D is a disc having a pair of curved flaps D1 at the sides thereof and extend downwardly to be inserted into the corresponding grooves of the lamp socket C. The insulator D includes two apertures D2 corresponding to the apertures C1 for insertion of the two leads E1 of lamp E to extend therethrough. The cylinder cap F includes a conical spring F1 disposed at an inner portion thereof and threads formed on an outer portion thereof, for threaded engagement with the cylinder A.

FIG. 6A shows a cross-sectional view of the conventional flashlight with batteries installed in the cylinder A and with the conical spring engaging and urging the battery towards the conducting strip C3. The reflector B1 engages the insulator D to urge the lamp socket C inwardly, which disengages the conducting strip C2 from the collar A1 of the cylinder A to form an open circuit. On the other hand, when the head thimble B is displaced relative to the cylinder A, the reflector B1 will disengage from the insulator D, and the conducting strip C2 will engage with the collar A1 of the cylinder A to close the flashlight circuit. A further movement of the head thimble B relative to the cylinder A will change the focus of the beam.

However, there are some shortcomings to be improved upon. For instance, the structure is complicated, and its assembly is more time consuming. Further, the fine leads of the lamp require careful installation to avoid having to discard parts that become damaged.

SUMMARY OF THE INVENTION

An object of the present invention is to provide an improved flashlight structure which is simple in structure, uses less parts and is conveniently assembled.

A further object of the present invention is to provide an improved bulb holder structure, in which a new peanut bulb with a screw shell is used.

DETAILED DESCRIPTION OF THE PREFERRED EMBODIMENTS

Figure 1:
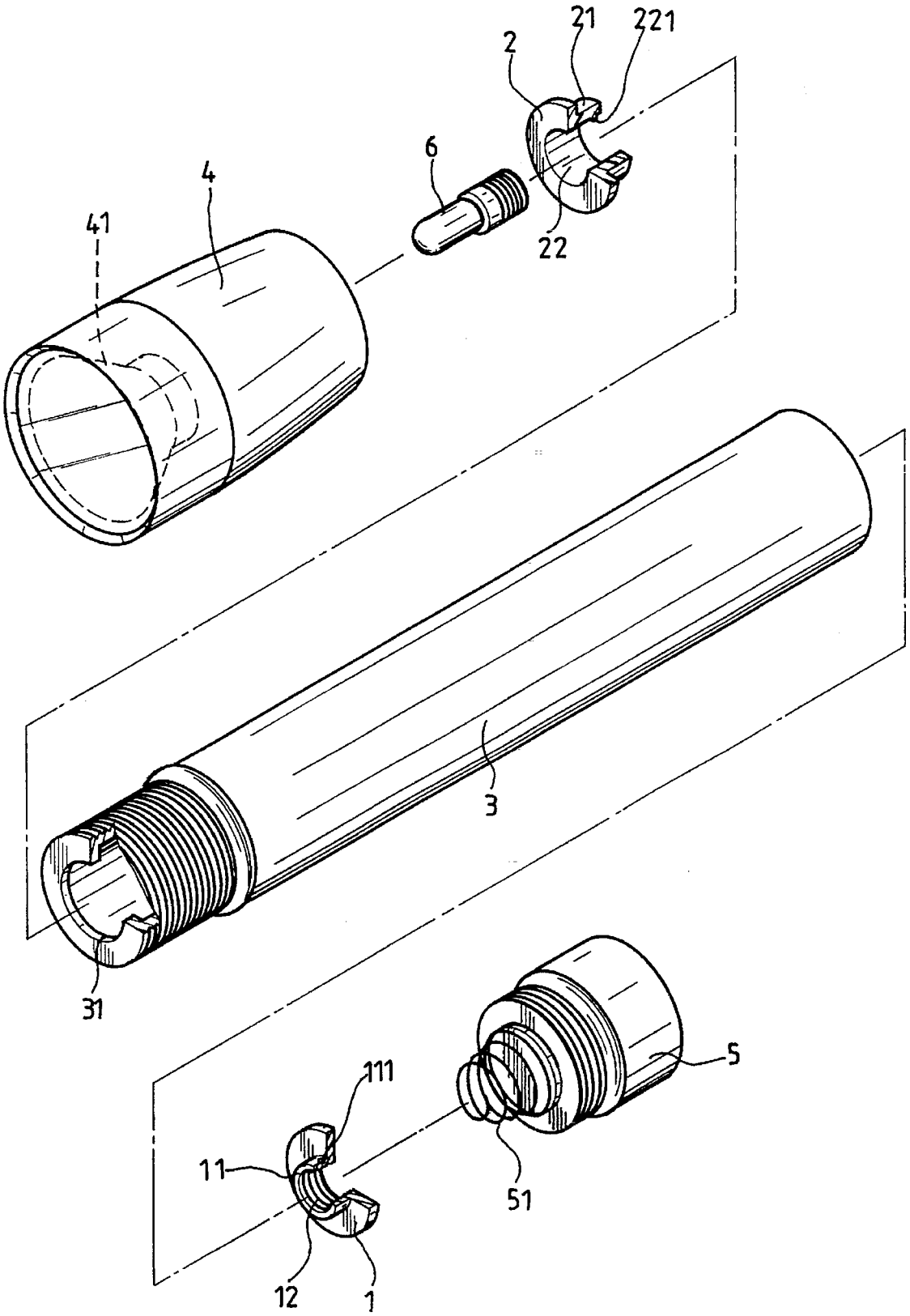
FIG. 1 is an exploded view of a first embodiment of the present invention.

Referring now to FIG. 1, the present invention relates to a bulb holder and is composed of a conducting cartridge 1 and a seat insulator 2. The bulb holder is threaded to a flashlight which includes a cylinder 3, a head thimble 4, a cylinder cap 5 and a peanut bulb 6. The cylinder 3 has a collar 31 at one end and threads on the outer surface thereat for a threaded connection with the head thimble 4. The head thimble 4 has a reflector 41 secured therein. The cylinder cap 5 includes a spring 51 fastened at a front end thereof, and threads which are formed on the outer surface adjacent the front end. The outer surface threads of the cap 5 facilitate connection to the internal threads of the cylinder 3. The outer surface threads of the cylinder 3 facilitates connection with the head thimble 4.

The conducting cartridge 1 is a metal stand (which is best made of copper) having a centrally formed threaded hole 12 and a flange 11 extending upwardly from one side of the cartridge 1 and surrounding the hole 12. A stop recess 111 is formed on the flange 11.

The seat insulator 2 is a stand formed of a non-conductive material, best made of a plastic material, having a centrally formed hole 22. A sleeve barrel 21 extends from one side of the seat insulator 2 surrounding the hole 22, and a protuberance 221 extends from the inner wall of the hole 21. The sleeve barrel 21 has a length greater than the thickness of the collar 31 of the cylinder 3 and an outer diameter that is smaller than the inner diameter of the cylinder 3. The hole 22 is dimensioned to receive the flange 11 therein, and the protuberance 221 will seat in the recess 111.

Figure 2:
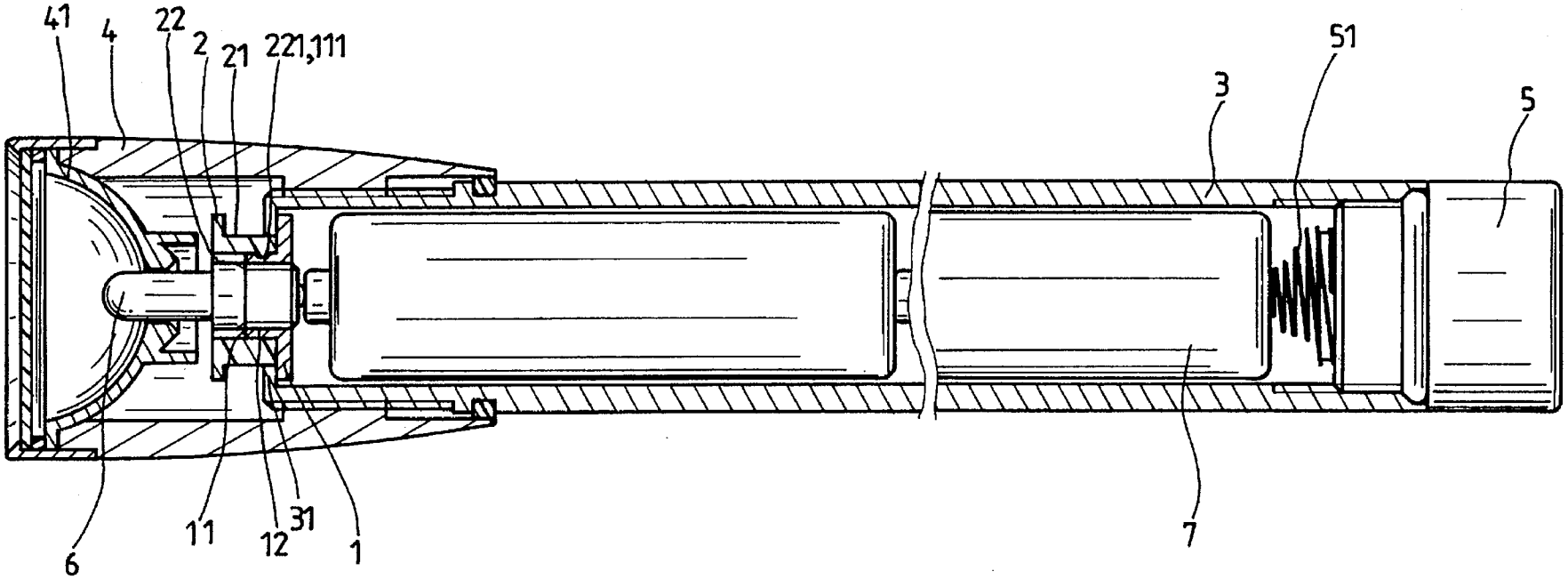
FIG. 2 is a side cross-sectional view of the embodiment of FIG. 1 showing the flashlight in a closed circuit.
Figure 3:
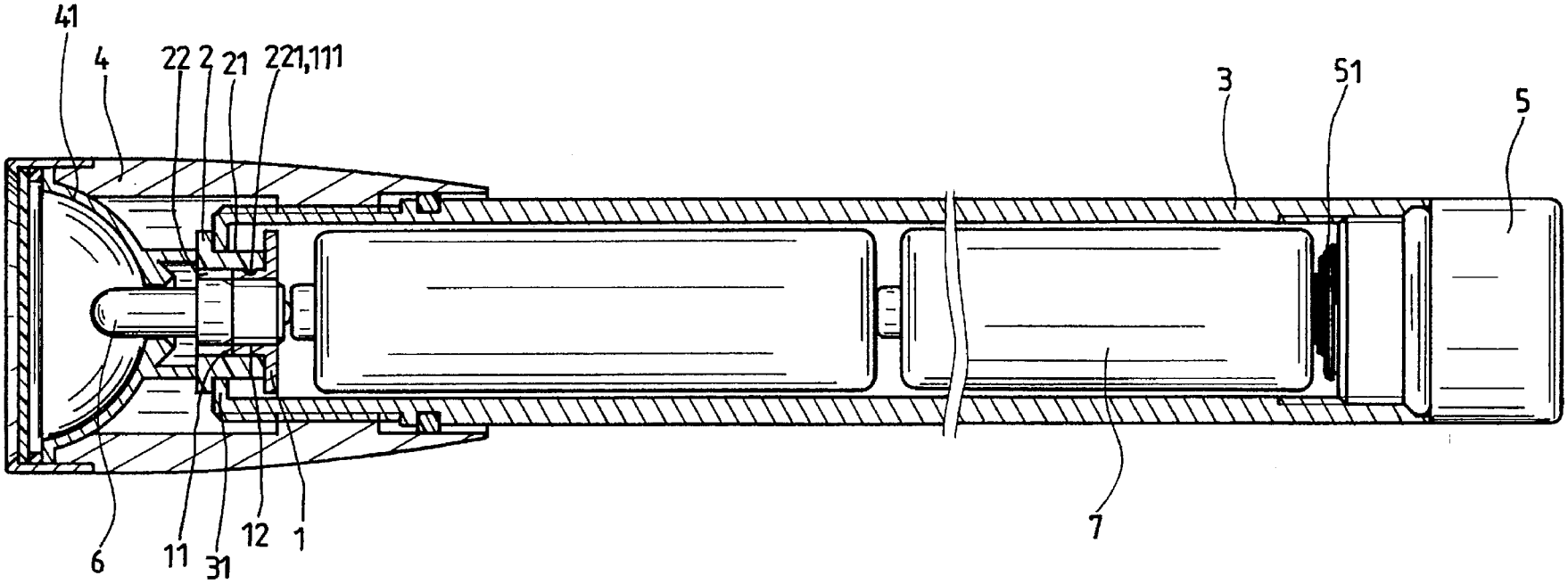
FIG. 3 is a side cross-sectional view of the embodiment of FIG. 1 showing the flashlight in an open circuit.

To assemble the present invention, the seat insulator 2 is first inserted into the cylinder 3 through the collar 31. Then, the flange 11 of the cartridge 1 is inserted into the hole 22 of the seat insulator 2, forming a bulb holder thereat. The bulb 6 is threadedly engaged within the threaded hole 11 of the conducting cartridge 1, as shown in FIG. 2. The batteries 7 are next placed into the battery compartment of the cylinder 3 and the end portion is covered by threadedly connecting the cylinder cap 5 to the cylinder 3, causing the spring 51 to engage the negative pole of the battery 7. The spring 51 urges the battery 7 forwardly, which urges the conducting cartridge 1 into engagement with the collar 31 of the cylinder 3, to form a closed circuit for the flashlight. Moreover, when threading the head thimble 4 to displace it rearwardly, the reflector 41 will move rearwardly, which in turn urges the seat insulator 2 and conducting cartridge 1 rearwardly to disengage the cartridge 1 from contact with the collar 31 of the cylinder 3, thus, the circuit is placed into an open state, as shown in FIG. 3.

Figure 4:
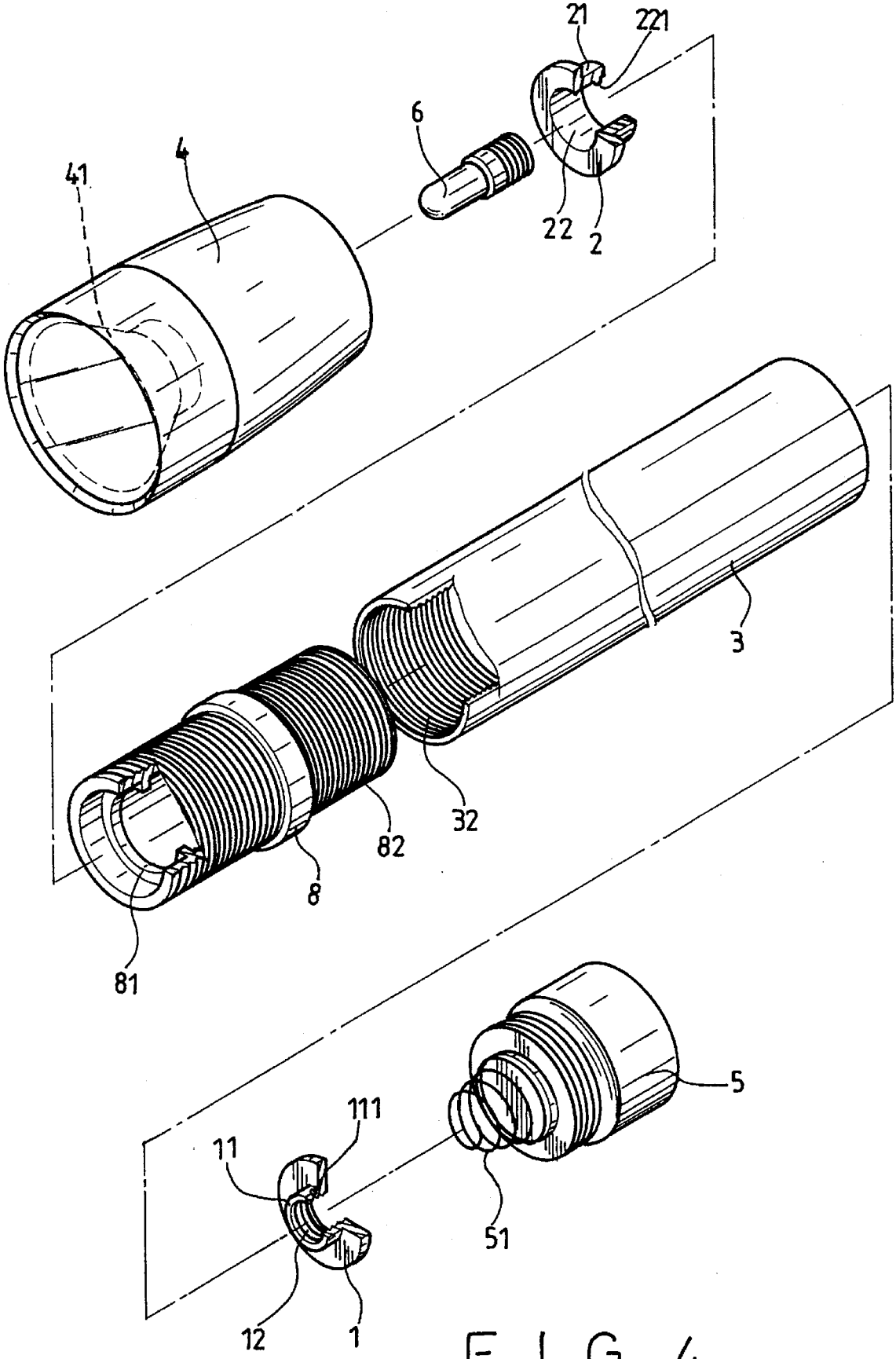
FIG. 4 is an exploded view of a second embodiment of the present invention.
Figure 5:
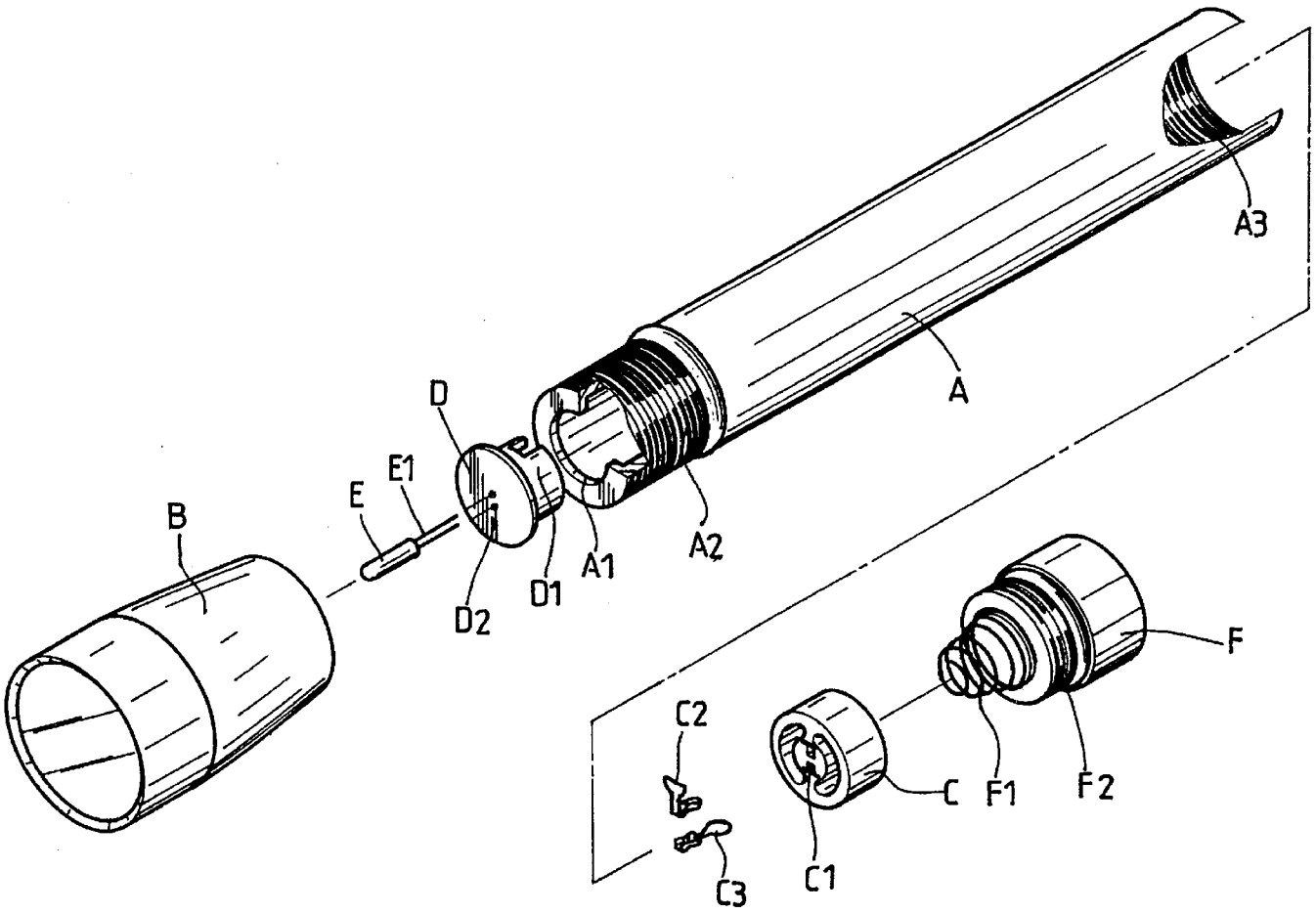
FIG. 5 (PRIOR ART)
FIG. 5 is an exploded view of a prior art flashlight.
Figure 6A:
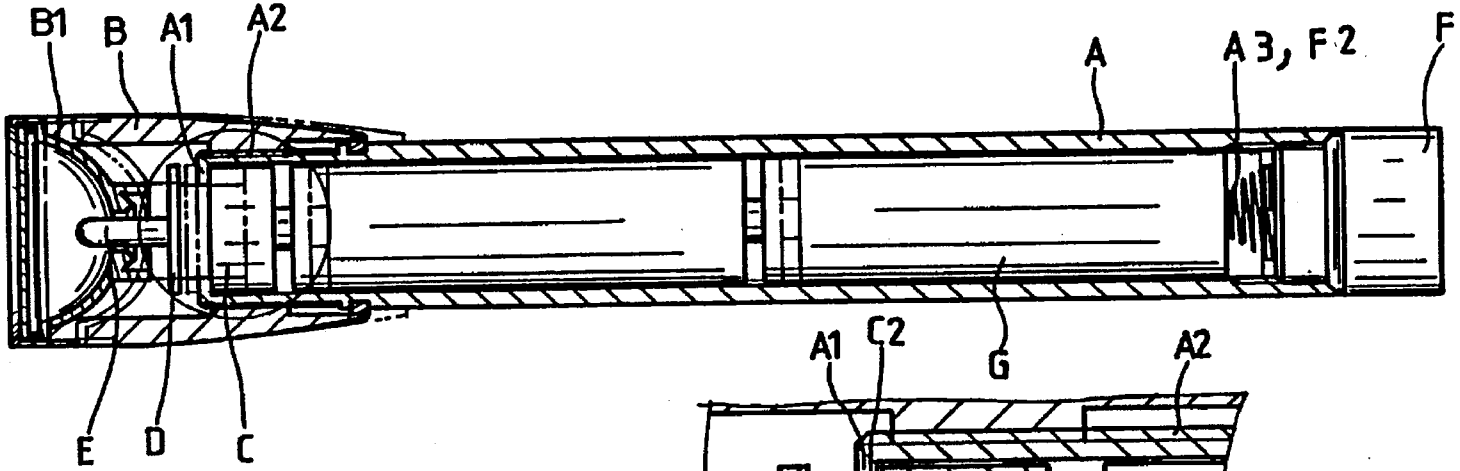
FIG. 6A (PRIOR ART)
FIG. 6A is a side cross-sectional view of FIG. 5.
Figure 6B:
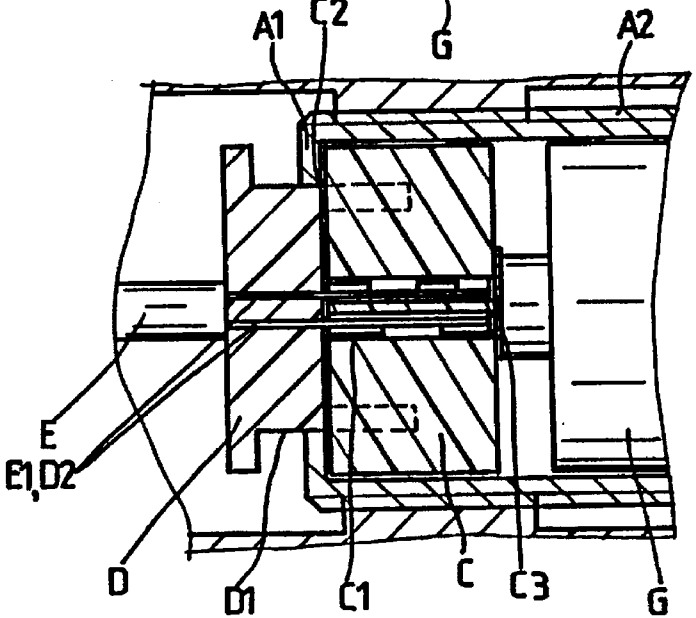
FIG. 6B (PRIOR ART)
FIG. 6B is an enlarged, partially sectioned, view of the circled portion of FIG. 6A.

In order to facilitate the assembly of the flashlight, cylinder 3, as shown in FIG. 4, is formed in two separate parts. One part is a battery compartment having threads 32 formed in an inner wall section adjacent a front end thereof. The other part is a cylinder adapter 8, which has a flange 81 which functions like that of the collar 31 of the first embodiment. Threads are formed adjacent the front portion of the adapter 8 to be threadedly connected with the head thimble 4. Threads 82 are formed adjacent the rear portion of the adapter to be threadedly connected with the internal threads 32 of the cylinder 3. The cylinder adapter 8 allows the conducting cartridge 1 and the seat insulator 2 to be installed prior to the assembly of the cylinder 3 to the cylinder adapter 8.

I claim:

1. A focusing flashlight comprising a conducting cartridge and a seat insulator secured at one end of and in contact with a collar of a cylinder, said conducting cartridge having an internally threaded hole centrally formed therethrough adapted to receive a bulb therein, said conducting cartridge having a flange extending from one side thereof around a perimeter portion of said hole, said seat insulator having a centrally formed hole and a sleeve barrel extending from a perimeter portion of said hole in said seat insulator, said sleeve barrel having a length dimension greater than a thickness dimension of said collar of said cylinder, said sleeve barrel having an outer diameter smaller than an inner diameter of said cylinder.

2. The focusing flashlight as recited in claim 1, wherein said cylinder is formed by a cylinder adapter secured to a battery compartment, said cylinder adapter having a flange formed at a front end thereof and external threads formed at a rear end portion for threaded connection with external threads of said battery compartment.

3. The focusing flashlight as recited in claim 1, wherein said seat insulator has a protuberance extending from one side of an inner wall thereof, and said conducting cartridge has a stop recess formed on an outer wall thereof adapted to receive said protuberance therein.

* * * * *